United States Patent [19]

Willis

[11] 4,063,686

[45] Dec. 20, 1977

[54] SPRAY NOZZLE

[75] Inventor: Daniel A. Willis, Whitehall, Pa.

[73] Assignee: Fuller Company, Catasauqua, Pa.

[21] Appl. No.: 667,225

[22] Filed: Mar. 15, 1976

[51] Int. Cl.[2] ..... B05B 1/32

[52] U.S. Cl. ..... 239/404; 239/434.5

[58] Field of Search ..... 239/401, 403, 404, 405, 239/406, 402, 424.5, 425, 434.5

[56] References Cited

U.S. PATENT DOCUMENTS

| | | | |
|---|---|---|---|
| 1,714,654 | 5/1929 | Ballgoe | 239/404 X |
| 1,827,235 | 10/1931 | Jarvis | 239/406 |
| 1,864,795 | 6/1932 | Boyd | 239/405 |
| 2,046,592 | 7/1936 | Tracy | 239/405 X |
| 2,570,669 | 10/1951 | Hannigan | 239/403 |
| 2,594,562 | 4/1952 | Jackson | 239/405 |
| 2,914,257 | 11/1959 | Wiant | 239/401 |
| 3,326,470 | 6/1967 | Loudin et al. | 239/404 |

*Primary Examiner*—John J. Love
*Assistant Examiner*—Michael Mar
*Attorney, Agent, or Firm*—Frank H. Thomson

[57] ABSTRACT

A spray nozzle which employs compressed air for atomizing the liquid to be sprayed and for projecting these droplets into the desired spray pattern. The nozzle includes a tubular member and a liquid supply conduit and nozzle head mounted within the tubular member. There is an annular passage through the nozzle with a converging portion and a portion diverging from the converging portion. Liquid and gas are supplied to the converging portion. The compressed gas is supplied in a manner to achieve swirling of both the gas and liquid within the converging portion. The compressed gas discharges the atomized liquid in a hollow conical spray pattern.

5 Claims, 4 Drawing Figures

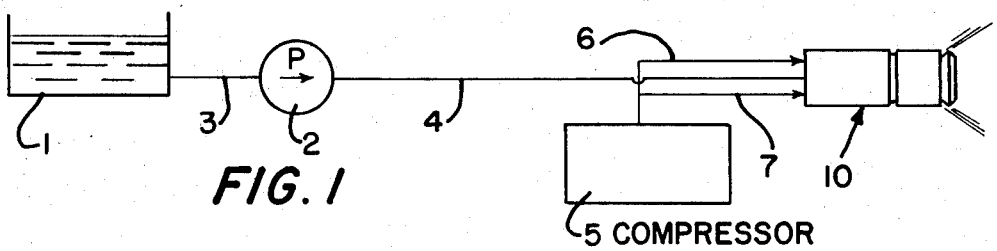
FIG. 1
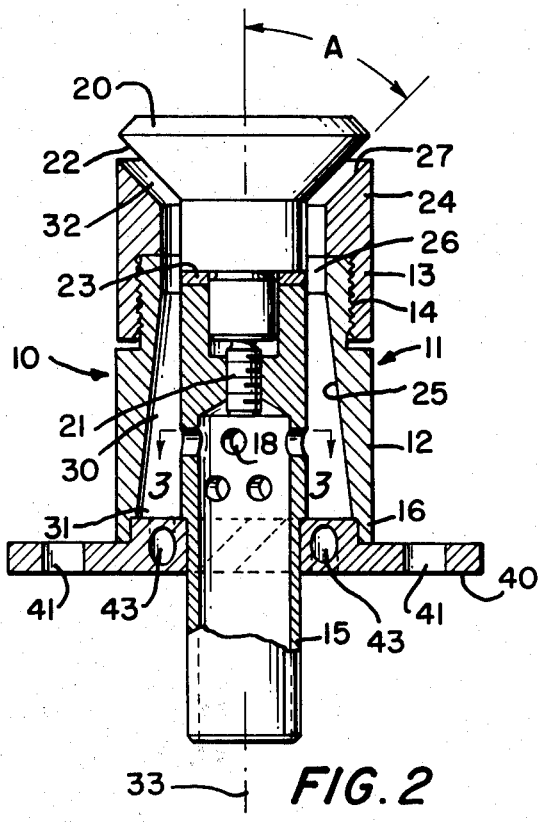
FIG. 2
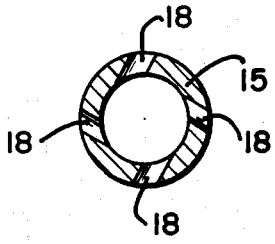
FIG. 3
FIG. 4
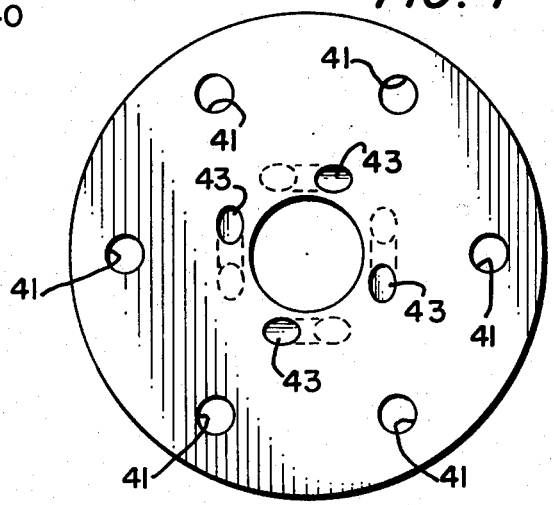

SPRAY NOZZLE

BACKGROUND OF THE INVENTION

Many types of liquid spray nozzles are known prior to the present invention. Many of these nozzles which are capable of generating fine liquid droplets on the order of 300 micron diameter or smaller have points of high frictional wear. The points of high wear cannot be eliminated by prior designs but the effects of these wear points can be reduced by the use of specialized materials. Some prior nozzles are incapable of handling liquids which contain more than a small portion of solids. This is because certain prior nozzles rely on small orifices to produce fine atomization of the liquid and these small orifices will tend to plug if the liquid being sprayed includes particulate material. The need to spray liquids containing particulate material is particularly important in certain applications of spray nozzles such as where a source of highly filtered liquid is not available.

Spray nozzles which produced a hollow cone spray were known prior to the present invention and one example is shown in U.S. Pat. No. 3,680,781. Most hollow cone sprays have a tendency for the spray to collapse on itself due to the existence of a lower pressure within the hollow core of the cone as compared with the ambient pressure. Collapsing of the cone has an adverse effect on the penetration of the spray as well as the area of coverage of the spray pattern. The elimination of this collapsing would therefore be an advantage.

A further disadvantage of known apparatus is that it is difficult to make field modifications to the nozzle when a different spray pattern is desired or when repairs are necessary.

A primary application of nozzles of the present invention is for cooling hot gases in applications such as spray towers and thermal processing equipment such as rotary kilns. Since most of these installations do not always have a readily available source of clean water, the ability to spray unfiltered water and still maintain a droplet size distribution conductive to good evaporative cooling efficiency is of primary concern.

Also of importance in this type of application is the spray pattern. Since the spray nozzle is often located in a duct or other confined vessel, it is important that the spray pattern be sufficiently large to cover the area through which the gas passes but not so large as to spray the walls of the duct or vessel. Such a situation would result in liquid running down the walls which could produce a muddy condition rather than merely cooling the gases. It is therefore important to have a spray nozzle which can be easily modified in the field in the event field conditions are not the same as had been anticipated during design. It is also important to not have a spray pattern which tends to collapse on itself because such a situation reduces coverage and adversely affects the penetration of the spray.

SUMMARY OF THE INVENTION

It is therefore the principal object of this invention to provide spray nozzle which eliminates the foregoing disadvantage of prior spray nozzles.

It is a further object of this invention to provide a novel spray nozzle which is capable of maintaining a desired spray pattern.

It is a still further object of this invention to provide a novel spray apparatus capable of achieving fine atomization of liquid to be sprayed and is capable of spraying contaminated liquid.

The foregoing and other objects of this invention will be carried out by providing a spray nozzle comprising: a first tubular member adapted to be connected to a source of compressed gas; a second tubular member extending into one end of said first tubular member and having at least one aperture therein and adapted to be connected to a source of liquid to be sprayed; a head mounted on said second tubular member at the other end of said first tubular member; said first tubular member, said second tubular member and said head defining an annular passage through said first tubular member having a converging portion and a diverging portion and liquid supplied to said second tubular member is supplied to said annular passage through said aperture; a gas orifice plate mounted on said on end of the first tubular member having at least one passage therethrough at an angle to the longitudinal axis of the annular passage through the first tubular member for supplying gaseous fluid to said annular passage whereby the gaseous fluid mixes with the liquid in said annular passage and the mixture is discharged from said annular passage past said head.

BRIEF DESCRIPTION OF THE DRAWINGS

The invention will be described in connection with the annexed drawings wherein:

FIG. 1 is a diagrammatic view of a system employing the present invention;

FIG. 2 is a sectional view of the apparatus of the present invention;

FIG. 3 is a sectional view taken on the line 3—3 of FIG. 2 in the direction of the arrows; and FIG. 4 is a plan view of a portion of the apparatus of the present invention.

DESCRIPTION OF THE PREFERRED EMBODIMENT

Referring to FIG. 1, there is shown a typical system for a pneumatic-hydraulic spray nozzle including a source 1 of liquid to be sprayed, a pump 2 for supplying liquid from the source 1 through conduits 3 and 4 to spray nozzle 10. There is also shown a compressor 5 suitably connected to conduits 6 and 7 for supplying compressed gas to the nozzle 10.

As an alternate the compressor may be connected to a manifold (not shown) and the manifold connected to the nozzle 10. The nozzle 10 of the present invention is best illustrated in FIG. 2 and includes a first tubular member 11 which may be formed of lower nozzle barrel 12 and an upper nozzle barrel 13 removably mounted on the lower nozzle barrel as by threaded connection 14. The threaded connection 14 permits disassembly of the tubular member 11.

The nozzle 10 also includes a second tubular member 15 extending into one end 16 of the first tubular member 11. The second tubular member 15 is adapted to be connected to the source 1 of liquid to be sprayed. The second tubular member 15 is generally cylindrical in configuration and includes at least one and preferably a plurality of apertures 18 to provide communication between the inside of tubular member 15 and the inside of the first tubular member 11. Preferrably the aperatures 18 are tangential to the inside of the tubular member 15 as shown in FIG. 3.

A generally conical head 20 is removably connected at 21 to the second tubular member 15. The head 20 has a conical side wall 22 at a suitable angle A. A washer 23 may be positioned between the head 20 and the end 24 of the second tubular member 15 to define means for permitting adjustment of the distance between the head 20 and the upper nozzle barrel 13.

The first tubular member includes an internal converging portion 25, a straight portion 26 and an internal diverging portion 27. The diverging portion 27 is also at an angle A. Thus, the first tubular member and the second tubular member define an annular passage 30 through the first tubular member and this annular passage includes a first converging portion 31 and a second portion or gap 32 diverging from the first portion 31. The annular passage 30 has a longitudinal axis 33. The converging portion 31 serves as a mixing chamber for gas and liquid.

The end 16 of the first tubular member 11 is generally closed by a gas orifice plate 40. This plate is also shown in FIG. 4 and may include a plurality of holes 41 around its periphery to secure the nozzle to a frame. This plate 40 surrounds and holds the second tubular member 15 in position and includes at least one and preferably a plurality of passages 43 therethrough for supplying compressed gas from conduits 6 and 7 or from a manifold to the annular passage 30. These passages are at an angle of preferably 45° to the longitudinal axis 33 of the passage 30.

In operation, the gas is supplied to the mixing chamber or converging portion 31 of the passage through openings 43 in the gas orifice plate 40. These passages accelerate the gas to sonic velocity. The angle of these passages will cause the gas to swirl or spiral within the converging portion 31 of the annular passage. The gas stream exiting from each of these passages will form oblique shock waves which intersect each other and reflect off the internal walls of the nozzle. These waves meet the liquid stream which is entering the converging portion 31 through passages 18. The liquid is broken up or shattered into small droplets by the multiple shock waves. The combined or mixed gas and atomized liquid impinge on the internal converging walls 25 at an angle causing the mixture to spiral down the first tubular member 15 within the converging portion 31. The droplet mixture then passes through the convergent mixing zone of the diverging passage 32 formed by conical walls 22 of the head 20 and internal diverging walls 27 further reducing the size of the liquid droplets. The divergent passage 32 directs the gas liquid mixture to produce the desired spray angle. The swirling pattern of the gas liquid mixture continues out of the nozzle 10 to produce a swirling hollow conical spray pattern.

In addition to the increased atomization of the liquid within the nozzle due to the passages 43 being at an angle, this positioning assists in maintaining the spray pattern by preventing its collapsing. It is believed that this is because the fluid will tend to spiral inward thereby conserving momentum. The tangential velocity of the particles increases as the radius decreases. This produces a segregation of the liquid droplets with regard to velocity so that the internal droplets of the hollow cone spray pattern tend to have a higher tangential velocity but a lower axial velocity as compared with the droplets on the outside of the spray pattern. The internal droplets tend to travel through the layer of outer droplets producing a collision and further reduction in droplet size. Because of the high tangential velocity of the internal droplets, the hollow spray cone pattern will tend to maintain iteself and not collapse upon itself, even though the pressure within the cone is less than atmosphere.

The present invention has the advantage that the head 20 and the upper portion 13 of the first cylindrical member can be changed so that a different angle A can be achieved. This angle is important as it controls the spray area to be covered and since spray penetration is a function of the spray angle, spray penetration is also controlled. In addition, the angle of the diverging portion 32 assists in atomization in that a greater angle between the divergent portion of the passage and the straight portion of the passage produces a finer atomization and lower liquid droplet velocity. It is preferable to have the angle on the conical head 20 the same as the angle as the divergent portion 27 of the first tubular member 11.

As previously set forth, the washer 23 can be used to adjust the distance between the head 20 and the upper nozzle barrel 13 and thus provide means for permitting adjustment of the size of the diverging portion or gap 32 of the passage 30. The ability to change the size of the gap is important in that it permits flexibility. The size of this portion of the annular passage will be set according to the volume of the water to be sprayed and the volume and pressure of the air used to spray the liquid. For example, a particular application may require 20 gallons of liquid to be sprayed using 200 cfm of air at 125 psig. In order to operate under these conditions a particular size gap 32 is needed and a washer 23 is selected to provide this size gap. After the nozzle has been placed into operation, it is determined that a greater volume of liquid is needed but the volume and pressure of air used is to remain constant. In order to spray the larger volume without increasing the air pressure, it is necessary to increase the size of the gap 32. This is accomplished by using a thicker washer 23 which raises the head 20 with respect to the first tubular member 11. If the original washer 23 was used, the increased liquid flow rate would result in an increased air pressure. Adjustments could be similarly made if it was determined that a lesser volume of liquid was required or a change in air volume or air pressure was required. Thus, it can be seen that the spray nozzle of the present invention can be easily modified according to the application requirements.

From the foregoing it should be apparent that the objects of the present invention have been carried out. A spray pattern has been achieved which will not tend to collapse upon itself. In addition, the apparatus permits modifications of the spray pattern by permitting easy changing of the head and appropriate nozzle parts.

It is intended that the foregoing be merely a description of the preferred embodiment, but that the invention be limited solely by that which is within the scope of the appended claims.

I claim:

1. A spray nozzle comprising:

a first tubular member adapted to be connected to a source of compressed gas;

a second tubular member extending into one end of said first tubular member and having at least one tangential aperture therein and adapted to be connected to a source of liquid to be sprayed;

a head mounted on said second tubular member at the other end of said first tubular member;

said first tubular member, said second tubular member and said head defining an annular passage through said first tubular member having a converging portion, a straight portion and a diverging portion and liquid supplied to said second tubular member is supplied to said annular passage through said tangential aperture;

said tangential aperture in said second tubular member being positioned to supply liquid into the converging portion of said annular passage; and a gas orifice plate mounted on said one end of the first tubular member surrounding said second tubular member and having at least one passage therethrough at an angle to the longitudinal axis of the annular passage through the first tubular member for supplying compressed gas from the source to the converging portion of said annular passage in a swirling pattern and for accelerating the compressed gas to sonic velocity for breaking into droplets and mixing with the liquid to be sprayed within the converging portion and the mixed liquid droplets and compressed gas pass through the straight portion and are discharged from the diverging portion in a swirling conical pattern.

2. A spray nozzle according to claim 1 wherein said second tubular member is generally cylindrical and said first tubular member has an internal converging portion, internal straight portion and an internal diverging portion.

3. A spray nozzle according to claim 2 wherein said head is generally conical in configuration and has a sidewall having an angle substantially the same as the angle of the internal diverging portion of the first tubular member.

4. A spray nozzle according to claim 3 further comprising means for permitting adjustment of the size of the diverging portion of the annular passage for controlling the volume of liquid which can be sprayed.

5. A spray nozzle according to claim 4 wherein said means for permitting adjustment includes washer means interposed between said head and said second tubular member and said head means is threadably connected to said second tubular member.

* * * * *